US009283654B2

(12) United States Patent
Weigmann et al.

(10) Patent No.: US 9,283,654 B2
(45) Date of Patent: Mar. 15, 2016

(54) METHOD OF GRINDING SPRING ENDS AND SPRING END GRINDING MACHINE

(71) Applicant: Wafios AG, Reutlingen (DE)

(72) Inventors: Uwe-Peter Weigmann, Nürtingen (DE); Egon Reich, Eningen (DE); Thomas Kuttler, Kusterdingen-Immenhausen (DE)

(73) Assignee: WAFIOS AG (DE)

( * ) Notice: Subject to any disclaimer, the term of this patent is extended or adjusted under 35 U.S.C. 154(b) by 0 days.

(21) Appl. No.: 14/376,284

(22) PCT Filed: Jan. 25, 2013

(86) PCT No.: PCT/EP2013/051455
§ 371 (c)(1),
(2) Date: Aug. 1, 2014

(87) PCT Pub. No.: WO2013/113628
PCT Pub. Date: Aug. 8, 2013

(65) Prior Publication Data

US 2015/0017881 A1 Jan. 15, 2015

(30) Foreign Application Priority Data

Feb. 1, 2012 (DE) ..... 10 2012 201 465

(51) Int. Cl.

| | |
|---|---|
| ***B24B 49/14*** | (2006.01) |
| ***B24B 7/17*** | (2006.01) |
| ***B24B 7/16*** | (2006.01) |
| ***B24B 49/18*** | (2006.01) |

(52) U.S. Cl.
CPC ..... *B24B 49/14* (2013.01); *B24B 7/167* (2013.01); *B24B 7/17* (2013.01); *B24B 49/18* (2013.01)

(58) Field of Classification Search
CPC ..... B24B 49/14; B24B 49/18; B24B 7/167; B24B 7/17
See application file for complete search history.

(56) References Cited

U.S. PATENT DOCUMENTS 4,217,734 A * 8/1980 Frei ..... 451/22
4,358,912 A 11/1982 Shigeru (Continued)

FOREIGN PATENT DOCUMENTS

| | | |
|---|---|---|
| DE | 1652125 | 12/1967 |
| EP | 0 722 810 | 4/1999 |

(Continued)

OTHER PUBLICATIONS

Neuhaus, G., "Problemlösungen für das Federendenschleifen," *Draht, Meisenbach*, Bamberg, DE, Feb. 1, 1999, vol. 50, No. 1, pp. 38-42.

(Continued)

*Primary Examiner* — Dung Van Nguyen
(74) *Attorney, Agent, or Firm* — DLA Piper LLP

(57) ABSTRACT

A method of grinding spring ends of helical compression springs is carried out using a numerically controlled spring end grinding machine having a grinding unit, a loading unit and a control unit that controls the loading unit and the grinding unit. The grinding unit has a pair of grinding wheels including two rotatable grinding wheels between which is formed a grinding space. The loading unit has at least one loading plate substantially rotatable axially parallel to the grinding wheels and has a plurality of out-of-axis spring receptacles, each to receive a helical compression spring.

8 Claims, 4 Drawing Sheets

(56) References Cited

U.S. PATENT DOCUMENTS

| | | | | |
|---|---|---|---|---|
| 5,196,353 | A * | 3/1993 | Sandhu et al. | 438/5 |
| 5,882,244 | A | 3/1999 | Hiyama et al. | |
| 6,012,967 | A * | 1/2000 | Satake et al. | 451/36 |
| 8,113,913 | B2 * | 2/2012 | Pietsch et al. | 451/7 |
| 8,267,741 | B2 * | 9/2012 | Kimura et al. | 451/5 |
| 2010/0151771 | A1 | 6/2010 | Nabeya | |
| 2013/0337723 | A1 * | 12/2013 | Tanimoto et al. | 451/6 |

FOREIGN PATENT DOCUMENTS

| | | |
|---|---|---|
| EP | 1 970 159 | 9/2008 |
| JP | 2009-279709 | 12/2009 |

OTHER PUBLICATIONS

German Office Action dated Oct. 10, 2012 from related German Application No. 10 2012 201 465.9.

* cited by examiner

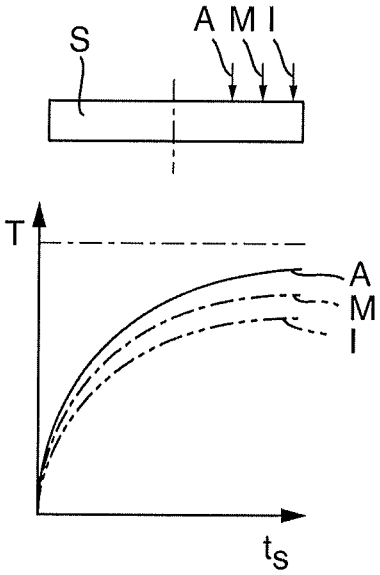
Fig. 5A
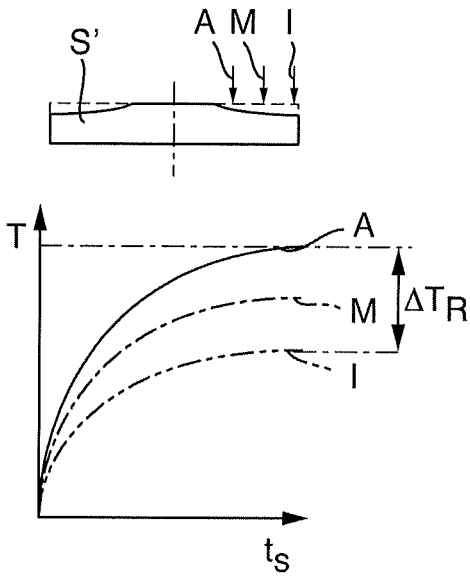
Fig. 5B
Fig. 5
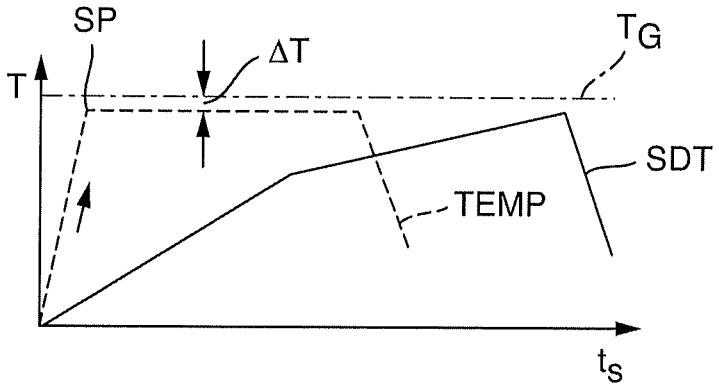
Fig. 6

METHOD OF GRINDING SPRING ENDS AND SPRING END GRINDING MACHINE

TECHNICAL FIELD

This disclosure relates to a method of grinding spring ends of helical compression springs- and to a spring end grinding machine suitable, in particular, to carry out the method.

BACKGROUND

Helical compression springs are machine elements required in large numbers and different configurations in numerous application areas. Helical compression springs are, for example, required in large quantities as supporting springs or valve springs in automobile construction. A helical compression spring may be described as a wound or coiled compression spring of wire with spacings between the turns.

Of particular importance for the reliable functioning of helical compression springs during use as intended are the spring ends, i.e. the two axial end regions of the helical compression springs. The spring ends transfer spring force to the connecting bodies and should generally be formed such that they are compressed as axially as possible in every position of the spring. Spring end grinding, i.e. machining material away from the spring ends by grinding, plays a part in this respect in creating on the spring ends bearing surfaces for the connecting bodies that are sufficiently at right angles to the spring axis.

Spring end grinding is part of the sequence of processes involved in the production of a helical compression spring from cold-formed wire. This sequence of processes comprises many further production steps, which finally lead to a ready-to-fit helical compression spring. Cost-effective production of helical compression springs is only possible if efficient production processes are realized in the various stages of the process. Spring end grinding is of particular importance in this respect since a large part of the production costs arising in helical compression springs are incurred by this operation. Therefore, considerable efforts are undertaken to control the process of spring end grinding such that the helical compression springs can be produced with high productivity without impairing the quality of the finished products.

In many areas, a double-sided face grinding process with unstressed springs has become the established method of spring end grinding. As is known, grinding with a rotating tool is a machining process involving geometrically undefined cutting. The term double-sided face grinding process is based on the type of surfaces to be generated (flat faces), the number of surfaces to be ground (two), the part of the grinding wheel primarily in engagement (side surface) and the process (grinding). A particular feature of that process is the fact that the helical compression springs apply the grinding pressure themselves.

A numerically controlled spring end grinding machine suitable for the double-sided face grinding process has a grinding unit, a loading unit and a control unit that controls the loading unit and the grinding unit. The grinding unit has a pair of grinding wheels comprising two rotatable grinding wheels, the axes of rotation of which are normally arranged coaxially in relation to one another or slightly tilted with respect to one another. Formed between the mutually facing side surfaces of the grinding wheels is a grinding space. The loading unit has at least one loading plate rotatable more or less axially parallel to the grinding wheels and has a plurality of out-of-axis spring receptacles, each to receive a helical spring. The spring axes of the helical compression springs received in the spring receptacles should in this case be as parallel as possible to the axis of rotation of the loading unit and, consequently, perpendicular to the grinding side surfaces of the grinding wheels.

In the grinding operation, there is a distance between the axes of the grinding wheels and the axis of rotation of the loading plate. During a grinding operation, those helical compression springs that have been received in spring receptacles of the loading plate are successively transported through the grinding space between the rotating grinding wheels by rotation of the loading plate. As this happens, both spring ends of the helical compression springs located in the grinding space are simultaneously machined by grinding.

The distance between the center of rotation of the loading plate and the center of the grinding wheels thereby determines the position of the grinding path. The grinding path or trace describes the path over the grinding wheel that the helical compression springs cover during rotation of the loading plate. The trace, the grinding rate, the rotational speed of the loading plate and the grinding pressure together determine the achievable grinding performance.

With regard to high productivity, it is generally endeavored to achieve a grinding performance that is as high as possible, i.e. a rate of removal per unit of time that is as high as possible. However, grinding performance is restricted by admissible temperature of the spring material and capability of the grinding wheels. If the spring material becomes too hot, material displacements may occur, adversely influencing the later behavior of the spring and/or the strength of the material. Therefore, material overheating should be avoided as much as possible.

Some processes provide active cooling of the grinding space and/or the loading plate. In the case of grinding space cooling, for example, fresh air is blown directly into the grinding space, with the aim of cooling down the helical compression springs, the chips and the abrasive particles, dissipating the frictional heat and blowing out the chip spaces. In the case of loading plate cooling, cooling air is blown into the helical compression springs. The goal is to increase the specific removal capacity by keeping the temperature of the helical compression springs in the process as constant as possible and sufficiently low.

JP 2009-279709 A describes a spring end grinding machine for double-sided face grinding in which two cooling plates parallel to one another are provided directly next to the grinding wheels outside the grinding space and their mutually facing end faces lie substantially as an extension of the mutually facing side surfaces of the grinding wheels. The cooling plates, which are cooled by a cooling fluid passed therethrough, bound a space which lies between the cooling plates and in which the helical compression springs move during rotation of the loading plate as soon as they leave the grinding space. The spring ends are in this case in physical contact with the cooling plates. In this way, contact cooling of the spring ends during a grinding operation is possible.

It could therefore be helpful to provide a method of grinding spring ends of helical compression springs and also a spring end grinding machine that carries out the method that can work with high productivity and at the same time offer a high degree of certainty in safeguarding against overheating of the machined helical compression springs.

SUMMARY

We provide a method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, including determining a temperature signal representing the temperature by a temperature measurement on at least one of the helical compression springs during the grinding operation; and controlling the spring end grinding machine depending on the temperature signal.

We also provide a spring end grinding machine that grinds spring ends of helical compression springs including: a grinding unit having a pair of grinding wheels including two rotatable grinding wheels between which there is formed a grinding space; a loading unit having at least one loading plate rotatable substantially axially parallel to the grinding wheels and having a plurality of out-of-axis spring receptacles, each receiving a helical compression spring; and a control unit that controls the loading unit and the grinding unit, wherein helical compression springs that have been received in spring receptacles can be successively transported through the grinding space by rotating a loading plate arranged in a working position and, as this happens, both spring ends of the helical compression springs located in the grinding space can be simultaneously machined by grinding; wherein a temperature measuring system with at least one temperature measuring device, set to determine a temperature signal representing the temperature on at least one of the helical compression springs during a grinding operation and passing it on for further processing, so that the spring end grinding machine can be controlled in dependence on the temperature signal.

BRIEF DESCRIPTION OF THE DRAWINGS

FIGS. 5A and 5B show diagrams of the dependence of the temperature of helical compression springs on the grinding time in the case of different radial distances of the helical compression springs from the center of rotation of the loading plate for a just dressed grinding wheel (FIG. 5A) and a radially unevenly worn grinding wheel (FIG. 5B).

FIG. 6 shows a comparison of temperature/grinding time progressions for a conventional grinding operation and for a temperature-controlled way of conducting the method according to one example.

Figure 1:
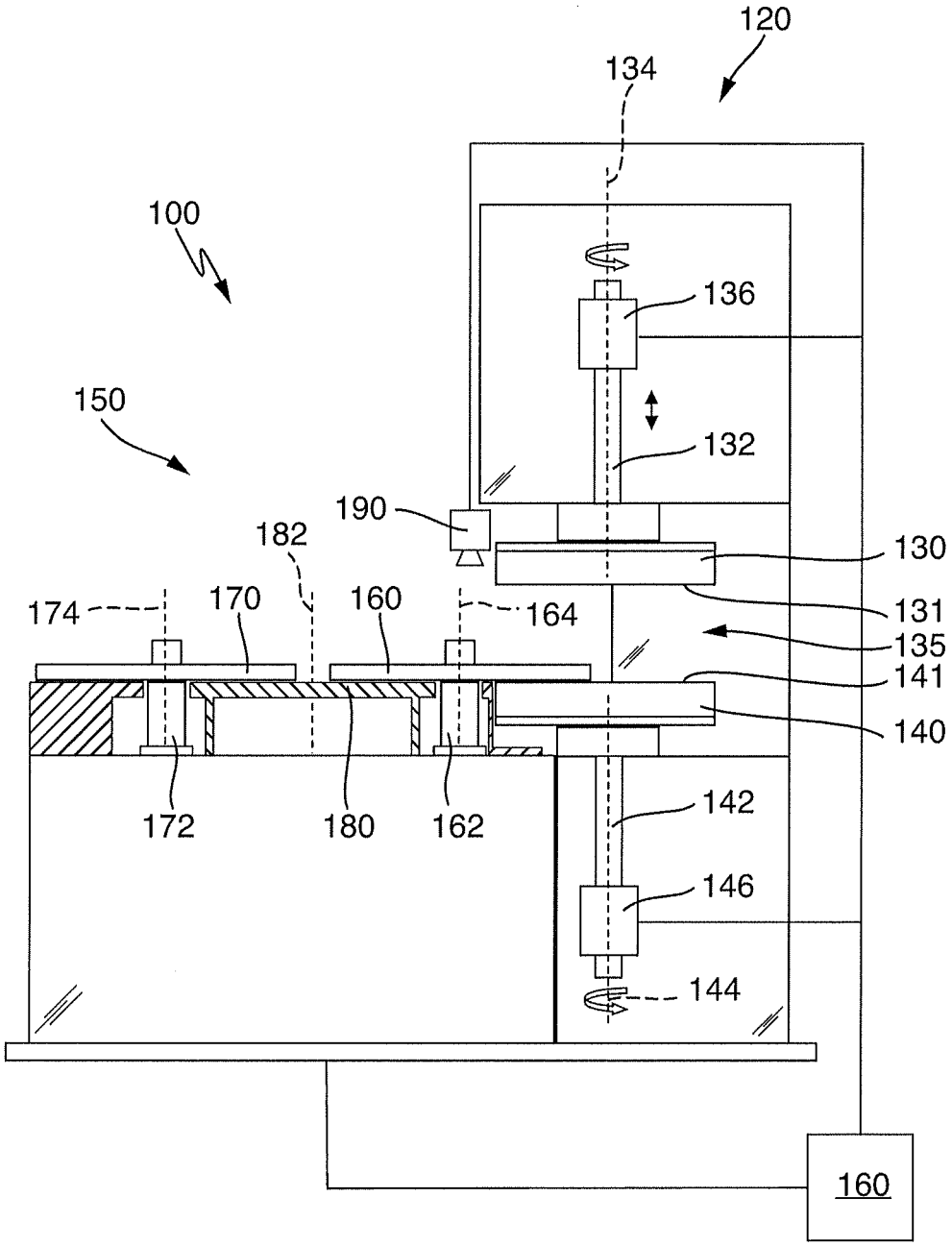
FIG. 1 shows a schematic side view of a spring end grinding machine according to one example.

Our methods are distinguished by the fact that a temperature signal representing the temperature is determined by a temperature measurement on at least one of the helical compression springs during the grinding operation and the spring end grinding machine is controlled in dependence on the temperature signal. The phrase "during the grinding operation" refers to the time interval between the beginning and the end of a grinding operation, the grinding operation beginning when helical compression springs first enter the grinding space and ending when the desired removal has been achieved and the last helical compression spring has left the grinding space. Consequently, direct temperature monitoring is carried out on helical compression springs during the grinding operation. Since the temperature measurement is carried out during the grinding operation, that is to say "in process", prompt temperature-dependent control of the grinding process is possible. As a result, if need be, the grinding process can be operated at the upper performance limit of the removal rate at which overheating is still reliably avoided. Direct temperature monitoring makes it possible to dispense with working with unnecessarily great safeguards against overheating of the spring material that restrict the performance capability of the grinding process more than necessary. It may be possible to dispense with complex cooling measures.

A spring end grinding machine that carries out our methods has a temperature measuring system with at least one temperature measuring device, which has been set up to determine a temperature signal representing the temperature on at least one of the helical compression springs during a grinding operation and passing it on for further processing so that the spring end grinding machine can be controlled in dependence on the temperature signal.

Since the spring ends heat up more intensely during the grinding than regions closer to the middle of the spring, the temperature is preferably determined as close as possible to (at least) one spring end, for example, in the region of a first turn adjoining a spring end. Measurements directly on the end face that is being machined by grinding are particularly reliable here.

The temperature measurement preferably takes place contactlessly by recording and evaluating thermal radiation emitted. For this purpose, a pyrometer or a thermal imaging camera may be used, for example, as the temperature measuring device. The use of (at least) one heat imaging camera (line scan camera or area scan camera) offers the additional advantage of a spatially resolving temperature measurement, in which measurements can be taken at the same time or at different times at two or more spaced-apart measuring positions on one helical compression spring or on a number of different helical springs.

Automatic closed-loop control of at least one grinding parameter preferably takes place in dependence on the spring temperature or the temperature signal representing this temperature. For this purpose, preferably, the temperature measuring device cable-connects to the control unit or wirelessly connects for signal transmission and a control program configured to process the temperature signal or a signal derived from it is active in the control unit, the control unit changing at least one operating parameter of the grinding unit and/or the loading unit in dependence on the temperature signal during the grinding operation. The operating parameters that can be changed may include, for example, the rotating speed of the loading plate and the rotating speeds of the two grinding wheels, which can preferably be changed independently of one another. If the spring end grinding machine has been set up for infeed grinding, the infeeding of a grinding wheel that can be infed in the direction of the other grinding wheel may alternatively or additionally also be controlled in dependence on the temperature signal.

As an alternative, semiautomatic closed-loop control, in which an operator is involved in the control process, is also possible. This may, for example, take place by an indicating device, for example, an optical indicating device and/or an acoustic indicating device, being activated on the basis of the temperature signal whenever the temperature signal indicates a heating up of the helical compression springs beyond a threshold value still considered to be uncritical. As a result, the operator is given the possibility of intervening in the grinding process by changing operating parameters of the grinding unit and/or the loading unit to avoid overheating of the helical compression springs.

The temperature-dependent open-loop or closed-loop control may be used in the case of the throughfeed grinding process and the infeed grinding process. As is known, throughfeed grinding refers to when the grinding wheels are not infed during the grinding operation and the final dimensions are achieved in one pass through the grinding space. In contrast, in infeed grinding, an infeeding movement of one of the grinding wheels takes place to grind the helical compression springs to the final dimensions. It may, for example, be a constant or timed infeeding movement proportional to the grinding force and is generated by electronic closed-loop control.

Particular advantages are obtained when the spring end grinding machine has been set up for the process of infeed grinding and is operated by the infeeding process. In infeed grinding, at least one of the grinding wheels is infed in the direction of the other grinding wheel during the grinding operation at an infeed rate predetermined by the control unit. In this case it is possible to control the infeed rate in dependence on the temperature signal, that is to say to carry out a temperature-dependent closed-loop control of the infeed rate.

Particularly high productivity is achieved in some cases by the infeed taking place at a predetermined maximum infeed rate, possibly that can be set by the operator until a switching point dependent on the type of helical compression spring and other process parameters is reached, a point at which the temperature has approached a predetermined limit temperature to within a predeterminable temperature difference. The "limit temperature" is a temperature of the spring material from which temperature-induced material damage can no longer be reliably ruled out. Therefore, the grinding process should as far as possible be conducted such that the limit temperature is not reached. Serving for this purpose is the temperature difference, which can possibly be set by inputs on the control, representing as it were a safety margin from the limit temperature. In this variant of the method, it is consequently possible to continue grinding at the predeterminable maximum infeed rate and, consequently, at the maximum removal rate as long as the temperature of the helical compression springs, the spring ends of the helical compression springs, does not as a result increase to become too close to the limit temperature.

After reaching the switching point, the infeed rate is then reduced to the extent that the limit temperature is not exceeded even thereafter. In particular, the infeed rate may be controlled after reaching the switching point such that a temperature difference from the limit temperature remains substantially constant. It is therefore possible to continue working at the optimum infeed rate close to the performance limit of the process, but on the safe side with regard to the risk of overheating.

In general terms, a limit temperature corresponding to a still just tolerable maximum temperature may be predetermined for a grinding operation, in dependence on properties of the spring material and the springs, and the control may be carried out such that the temperature of the helical compression spring does not exceed the predetermined limit temperature at any time during the grinding operation. Exceptions may possibly be allowed in the initial phase of a grinding operation if it is ensured that possibly overheated regions are still removed to a sufficient extent in the further course of the grinding operation, so that the finished product does not contain any portions that may be damaged by overheating.

Although it is possible to measure the temperature of the helical compression spring during the grinding engagement, that is to say while the helical compression springs are within the grinding space, it is preferred if the temperature signal is determined outside the grinding space. In terms of structural design, this makes relatively simple solutions possible, solutions that also have the advantage that the temperature measurement is not directly impaired by the grinding process.

A particularly reliable grinding process is achieved in some examples by determination of the temperature signal on a helical compression spring taking place immediately after the compression spring has left the grinding space. During a grinding operation, the helical compression springs are generally transported through the grinding space repeatedly on arcuate grinding paths. As a result, there is a change between a grinding phase, in which the helical compression springs are located between the grinding wheels and their spring ends are ground, and a disengaged circulating phase, which begins with the helical compression springs leaving the grinding space and ends with the helical compression springs re-entering the grinding space. Determination of the temperature signal therefore preferably takes place at the beginning of the disengaged circulating phase, that is to say at the beginning of an interim cooling phase. Since in this case the helical compression spring cannot cool down, or only very little, between the machining by grinding and the time of the measurement, the temperature signal may be regarded as representative of the maximum temperature reached during the grinding engagement, there being at most a small constant difference from the maximum temperature actually reached. As a result, the closed-loop control becomes particularly reliable.

It is also possible to measure at least two points of the disengaged circulation, for example on the one hand immediately after leaving the grinding space and on the other hand immediately before entering the grinding space. This allows a temperature decrease resulting from the grinding process and is characteristic of the grinding process at the time to be recorded for given parameters such as infeed, rotational speed, possible spring parameters or the like, and quantified, for example, by a temperature difference. Consequently, the influence of the environment or the cooling outside the grinding space can be recorded and taken into account in the control. As a result, a learning process can be obtained.

In many cases, a loading plate has two, three or more spring receptacles arranged in concentric rings so that great numbers of helical compression springs can be ground per unit of time. If the spring receptacles are loaded, helical compression springs are arranged at different radial distances from the axis of rotation of the loading plate. In one example of our methods, we provide that separate temperature signals are recorded for at least two radial distances and are processed together. If the temperature is measured in two, three or more different radial positions, it is possible, for example, to identify by way of the temperature difference uneven wear of the grinding wheel in the radial direction. In this way it is possible, for example, to determine an optimum time for the dressing of the grinding wheels, which may be reached, for example, when the temperature difference exceeds a predetermined difference value.

Data for a radial dressing profile of a grinding wheel may be determined on the basis of the separate temperature signals and/or the state of wear of the grinding wheel is assessed on the basis of the separate temperature signals. In this way, consistently good grinding results can be achieved. By this measure, it is possible to take into account that the grinding wheels generally wear unevenly in the radial direction. As a consequence, the temperatures of those helical compression springs ground closer to the outer circumference of the grinding wheel are generally lower than the temperatures of those helical compression springs passing by closer to the center of rotation of the grinding wheels. This unevenness can be reduced or eliminated by dressing.

In an example of our methods, the temperature is recorded again at radially different positions immediately after the dressing. In this way, any changing of the dresser can be monitored and an optimum time to exchange the dresser can be established.

The temperature measuring device may work on different principles. In some examples, at least one temperature sensor that measures over a surface area is provided, for example, in the form of an infrared camera or a thermal imaging camera. Two or more measuring regions may possibly be defined in its image field so that the temperature at different points of a helical compression spring or else on different helical compression springs can be measured at the same time. It is also possible to use one or more temperature measuring sensors that measure at discrete points.

Some examples of spring end grinding machines are provided with a movable protective shield, which may, for example, be designed in a curved and/or angled form and in its operational position closes off the grinding space in the direction of the exposed part of the loading plate. A temperature measuring device is preferably attached to the side of the protective shield facing away from the grinding wheels. This allows the temperature measurement to take place immediately after the helical compression springs have left the grinding space. At the same time it is ensured that the temperature measurement is not disturbed by possible flying sparks.

Our methods and devices may take into account that between a changing of a grinding parameter and an accompanying or thereby caused changing of the temperature of helical springs there is a time-dependent functional relationship (i.e. a time function), which may depend inter alia on the grinding conditions (such as, for example, the rotational speed, infeed rate, type of grinding wheels), on the wire used for the helical compression spring, on the form of spring and further parameters.

If these relationships are taken into account, a more precise and still more efficient way of conducting the method is possible. It may be provided for this purpose that reference grinding operation data, which represent at least one time-dependent functional relationship between the changing of a grinding parameter and a thereupon-dependent changing of the temperature of helical compression springs, are stored or have been stored in a memory of the control unit, the grinding process being controlled with the reference grinding operation data being taken into account. As a result, anticipatory (predictive) closed-loop control of the grinding operation is possible.

To obtain particularly realistic and reliable reference grinding operation data, at least one reference grinding operation is preferably carried out before a grinding operation intended for a production process to determine reference grinding operation data. These data are consequently determined experimentally. In principle, it is also possible to determine reference grinding operation data theoretically on the basis of suitable models. Preferably, the data obtained should also in this case be checked, and possibly refined, on the basis of experiments.

In a reference grinding operation, typical parameters such as, for example, the infeed rate and/or cutting rate, are changed and the influence, over time and/or in quantitative terms, of changing these parameters on the temperature of the helical compression springs is measured. The reference grinding operation data thus obtained can be used to derive rules and/or formulas from which the control unit can, for example, deduce at which time and in what way a correction must be performed so that any exceeding of an admissible maximum temperature during the grinding operation can be avoided with certainty.

For example, it may be that, in a grinding operation, the infeedable grinding wheel is infed very quickly, i.e. at a high infeed rate so that the temperature of the ground springs increases sharply. Without anticipatory closed-loop control, the infeeding can, for example, be stopped when a predetermined admissible maximum temperature is reached. However, under some circumstances the helical compression springs are still prestressed, so that the helical compression springs would continue to heat up. Therefore, it would in this case be advantageous to reduce the infeed rate already at an earlier time. The correct time can be set on the basis of the reference grinding operation data. To reduce the prestress quickly, it may possibly even be necessary to take the infeed into the negative range. The optimum time for when the changing of the infeed rate should begin, and also the extent to which the change should be made to avoid an "overshooting" of the temperature, can be determined with the aid of one or more reference grinding operations or grinding trials.

Spring end grinding machines with grinding space cooling and/or with loading plate cooling are typically provided with one or more fans, which by way of suitable lines blow air into the regions to be cooled. These cooling measures generally only bring about the desired air stream and cooling effect in combination with a sufficient suction extraction output. Suction extraction is understood to mean removal from the working area of the machine of components occurring as a result of the process. For example, metallic chips and metal particles, remains of abrasive material, process heat and sparks as well as vapors of organic and inorganic lubricants are extracted by suction. Extractor fans with considerable suction extraction outputs are generally provided for this purpose. Preferred controlling of the introduction of air into the grinding machine and/or of the suction extraction can be achieved on the basis of the temperature measurement, by the control of fans that supply air and/or extract air by suction taking place in dependence on temperature signals of the temperature measurement. The fan output at the time may be regarded as a further operating parameter of the spring end grinding machine. In this way, the fans and the suction extraction can be optimized with respect to power demand and efficiency.

In this way it is possible to take into account inter alia that there are different requirements for suction extraction and blowing in, for example, in the case of helical compression springs of different heights and/or different degrees of filling of the loading plate. The fan outputs may correspondingly be adjusted to values below their maximum fan output so that energy-efficient operation is ensured, while at the same time avoiding overheating of the helical compression springs. In an example of our methods, the maximum fan output for blowing in and/or suction extraction is still used to start with at the beginning of a grinding operation. After that, the fan output is reduced step by step or continuously on the basis of a predeterminable time schedule, and the effect on the temperature of the helical spring is monitored. In this way it can be checked whether use of the fans is necessary at all, or with which output (lying below the maximum output) they can work to ensure trouble-free operation. In this way, a considerable reduction of the energy consumption of the spring end grinding machine is possible. The closed-loop control of the grinding parameters may take place on the basis of a combination of measured temperature values and values for the torque of the grinding wheels.

These and further features emerge from the description and the drawings, where the individual features can be realized in each case by themselves or as a plurality in the form of subcombinations and constitute advantageous and inherently protectable examples. Examples are represented in the drawings and explained in more detail below.

Particular aspects of examples are presented below of a vertically constructed spring end grinding machine 100, which has been set up for the dry machining of helical compression springs (also referred to more simply as springs) by the double-sided face grinding process with unstressed springs in the infeeding process. The machine is of a single type of construction, with two grinding spindles and two loading plates. It substantially comprises a grinding unit 120, a loading unit 150 and also a control unit 160 to control controllable components of the loading unit 150 and of the grinding unit 120.

The grinding unit 120 has a pair of grinding wheels comprising two coaxially rotatable grinding wheels 130, 140, between which a grinding space 135 is formed during operation of the machine. The upper grinding wheel 130 is fastened to the lower end of an upper grinding spindle 132, which is mounted with a vertical axis of rotation 134 in the upper part of the supporting structure of the grinding unit and can be driven by an upper motor 136. The lower grinding wheel 140 is supported by a lower grinding spindle 142, which is rotatably mounted in the lower part of the supporting structure and can be rotated by a lower motor 146 about a vertical axis of rotation 144 running coaxially in relation to the axis of rotation 134 of the upper grinding spindle.

The grinding space of variable height is bounded upwardly by the side surface 131 of the upper grinding wheel 130, running substantially perpendicularly in relation to the axis of rotation 134, and downwardly by the side surface 141 of the lower grinding wheel, aligned substantially perpendicularly in relation to the lower axis of rotation 144.

The upper functional unit with the upper grinding spindle 132 and the motor 136 is adjustable in height to adapt to different lengths of spring. The lower grinding spindle is vertically movable to allow an adaptation to different lengths of spring. In examples that may also be used for spring end grinding by the throughfeed process, it is provided as an option to bring one of the grinding wheels or one of the grinding spindles into a defined oblique position. To be able to carry out a grinding process by the infeeding process, the upper grinding spindle 132 can be infed in the direction of the lower grinding wheel by movement parallel to the spindle axis 134, it being possible for the infeed rate or the infeed rate profile to be predetermined by the control unit 160.

The loading unit 150, arranged directly next to the grinding unit 120, has two loading plates 160, 170, unlimitedly rotatable axially parallel to the grinding wheels and together supported by a rotary table 180, which is rotatable about a vertical axis of rotation 182 by a drive that is not shown. The first loading plate 160 is supported by a first loading plate shaft 162 mounted on the rotary table with a vertical axis of rotation 164. In FIG. 1, the first loading plate is located in its working position with partial engagement in the grinding space. The second loading plate 170 is supported by a second loading plate shaft 172 rotatable about a vertical axis of rotation 174. The axes of rotation of the loading plates lie in diametrically opposed positions at the same radial distances from the axis of rotation 182 of the rotary table. The second loading plate is located in its loading position, which allows loading and unloading of the spring receptacles by machine or manually. The loading plates can in each case be easily exchanged to set up the machine for different spring geometries.

The loading plate shafts may in each case be driven by their own drives. It is also possible to attach a single drive in the region of the working position and couple the loading plate shaft of the loading plate that has been respectively moved into the working position mechanically to this drive (cf. EP 0 722 810 B1). Instead of a rotary table, linearly movable units may also be provided as supports for the loading plates (cf. DE 1 652 125).

Figure 4:
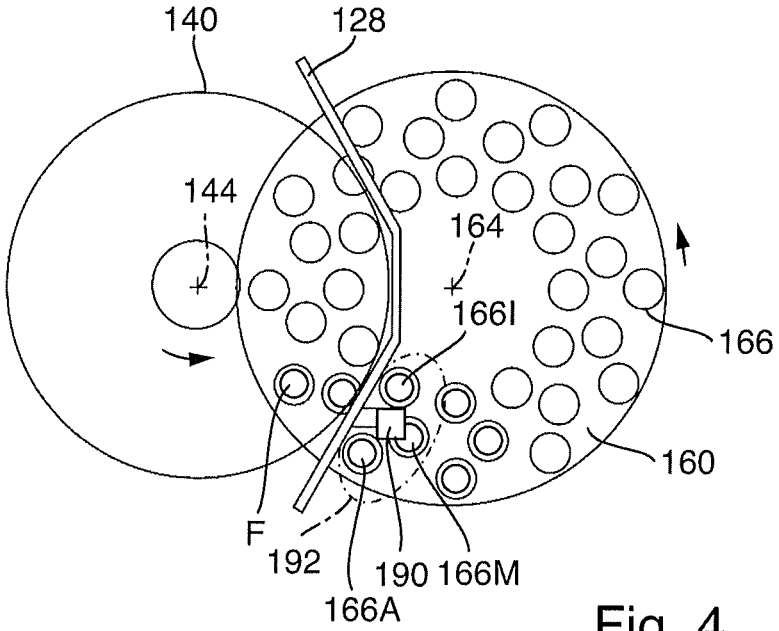
FIG. 4 shows a schematic plan view of the region of the grinding wheels and of a loading plate during a grinding operation.

Each loading plate has a plurality of spring receptacles 166 arranged out-of-axis in relation to its axis of rotation and intended to receive in each case a single helical compression spring F for the machining. Helical compression springs generally have a cylindrical form; other forms such as, for example, conical forms, convex or concave double-conical forms or cylindrical forms with conical spring ends are possible. Spring receptacles may be used with and without spring bushings. Single-level or multi-level loading plates may be used. In an example, the loading plates are single-level and have spring receptacles at three different radial distances from the axis of rotation of the loading plate. The spring receptacles are arranged in three concentric rings or rows around the axis of rotation (cf. FIG. 2 or 4).

Figure 2:
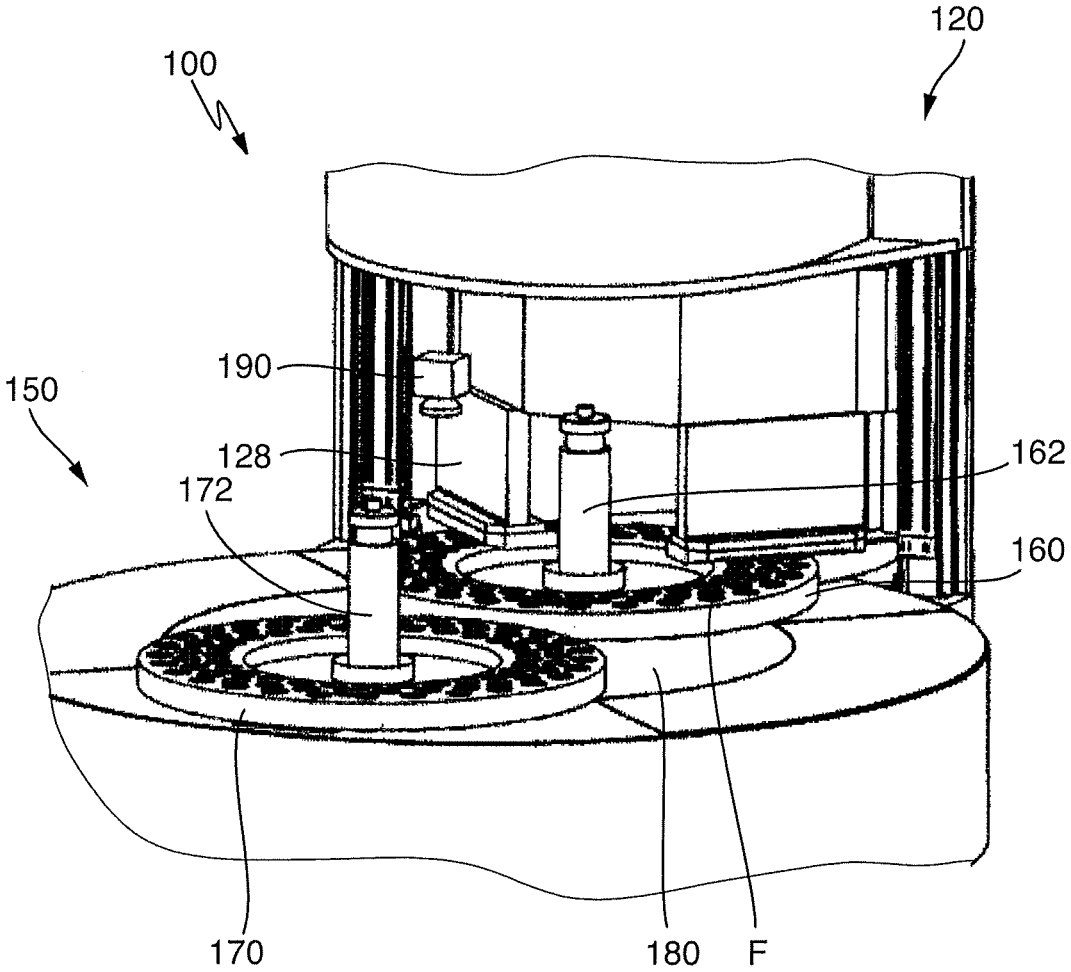
FIG. 2 shows in a perspective representation details of the spring end grinding machine from FIG. 1.

The loading plates can in each case be moved back and forth between a working position and a loading position by rotation of the rotary table 180. In the representations of FIGS. 1 and 2, the first loading plate 160 is in its working position, while the second loading plate 170 is in the loading position. In the working position, the axial distance between the center of rotation of the grinding wheels, i.e. their axes of rotation, and the axis of rotation 164 of the loading plate is dimensioned such that, when the loading plate rotates about its axis of rotation, all of the spring receptacles are transported on an arcuate grinding path or trace through the grinding space between the rotating grinding wheels. During this rotating movement, the two opposite spring ends of the helical compression springs located in the grinding space are in each case ground simultaneously by the side surfaces of the grinding wheels thereby coming into contact. In this case, the achievable removal rate is determined substantially by the position of the trace of the individual helical compression springs in the grinding space, by the grinding rate, the rotational speed of the loading plate and the grinding pressure occurring on the respective machined surfaces.

To protect the part of the loading unit lying outside the grinding space 135 and also the surroundings from flying sparks during the grinding process, remains of abrasive matter and noise, the spring end grinding machine has on the side of the grinding unit facing the loading unit a vertically movable protective shield 128, which may be configured in one or more parts and in the example is designed as angled in a curved form. When setting up the machine, the protective shield is raised so that the region between the grinding wheels is easily accessible. Before the beginning of the grinding operation, the protective shield is lowered, until its lower edge lies a small distance above the helical compression springs that have been received in the loading plate.

The spring end grinding machine 100 can be operated with very high productivity without there being the risk of overheating of the helical compression springs just machined and a resultant impairment of the quality of the springs. This is achieved in the case of the spring end grinding machine 100 by the temperature of the springs being measured during the grinding process or during a grinding operation and the infeed rate of the upper grinding wheel being controlled on the basis of the temperature measurement such that it is always possible to grind with a maximum infeed rate at which overheating with a material-changing effect can still be reliably avoided. If, for example, the sharpness of one of the grinding wheels changes due to self-sharpening and/or due to intermittent dressing, this can be detected with the aid of the temperature measuring system and an immediate response provided by adapting the infeed rate during the grinding without operator intervention.

Figure 3:
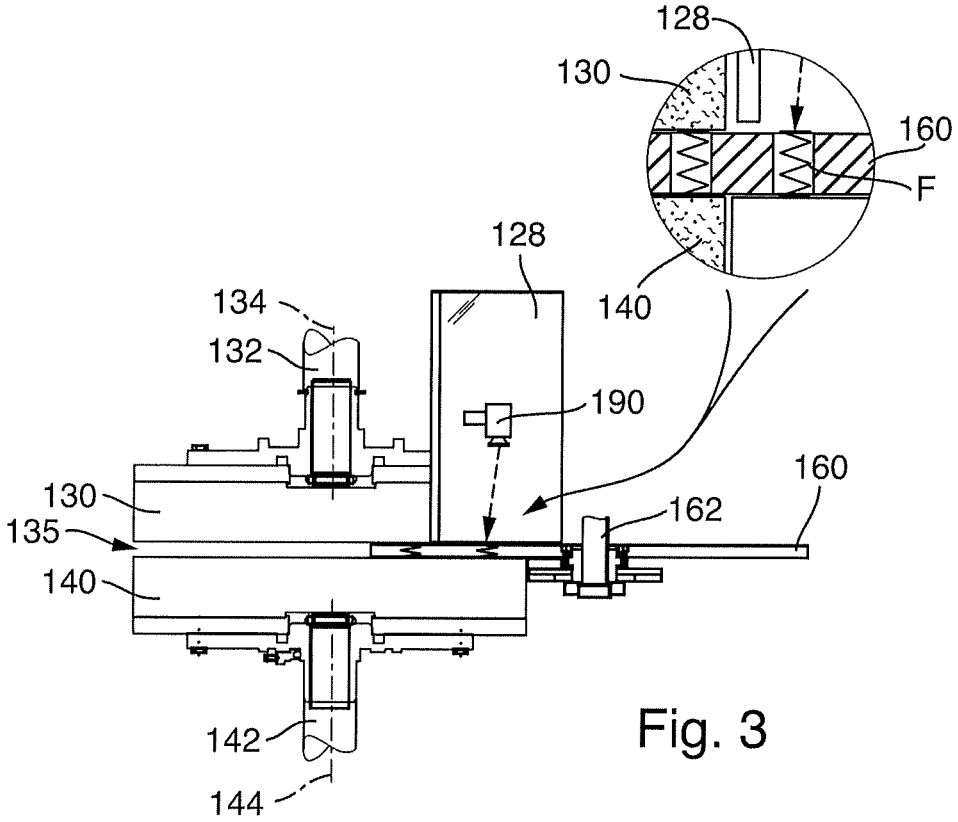
FIG. 3 shows a schematic side view of the region of the grinding wheels and of a loading plate during a grinding operation.

The temperature measuring system of the example has a temperature measuring device in the form of a thermal imaging camera 190, which connects to the control unit 160. The thermal imaging camera 190 attaches to the outer side of the protective shield 128 at a suitable distance above the loading plate 160 located in the working position such that the traces of all three rows of spring receptacles 166A, 166M, 166I pass through the generally rectangular two-dimensional image field 192 of the thermal imaging camera. The thermal imaging camera has a two-dimensional temperature sensor sensitive to infrared light and allows a two-dimensional spatially resolving temperature measurement. The thermal imaging camera is directed from above onto the helical compression springs leaving the grinding space so that the temperature at the upper end faces of the helical compression springs machined immediately beforehand by grinding can be measured immediately after leaving the grinding space (see arrows in FIG. 3). A number of measuring regions may be defined within the image field for a simultaneous temperature measurement so that it is possible to generate separately for each of the three rows of helical compression springs a temperature signal of its own and to pass them on to the control device 160.

A control program is active in the control unit 160 and can further process the temperature signals generated by the thermal imaging camera so that the control of the units of the spring end grinding machine connected to the control unit can take place on the basis of the results of the temperature measurement. Included among the operating parameters that can be controlled in an open-loop or closed-loop mode on the basis of temperature signals are the infeeding of one or more grinding wheels, the rotational speed of the loading plate located in the working position, the rotational speed of the upper grinding wheel and/or the rotational speed of the lower grinding wheel. On the basis of temperature signals, information on the state of wear of the grinding wheels can also be determined. Some possibilities are explained in more detail below.

FIG. 5 schematically shows in Sub-FIGS. 5A and 5B, respectively, at the top the state of wear of the lower grinding wheel and, under that, a temperature/time diagram representing the dependence of the temperature T of the end faces of helical compression springs in the three rows at different distances away from the center of rotation of the loading plate as a function of the grinding time $t_S$. The curve identified by "I" represents there the temperature progression of the inner row (smallest distance from the center of rotation), the letter "M" represents the middle row and the letter "A" represents the outer row, the helical compression springs of which are at the greatest distance from the center of rotation of the loading plate.

FIG. 5A shows the temperature progressions obtained on a newly dressed grinding wheel S, the side surface of which that is intended for grinding engagement is still flat and good for cutting. In the example, the temperature after a certain grinding time is somewhat higher in the case of the helical compression springs of the outer row A than in the case of the inner row I. The situation could also be reversed. FIG. 5B shows a later situation, in which radially uneven wear of the grinding wheel S has already taken place. It is evident that the temperature differences between individual rows have become greater. The wear was less in the inner region of the grinding wheel, closer to the center of rotation of the grinding wheel so that here there is a higher grinding pressure, which causes the higher temperature of the outer row A. It is consequently evident that it is possible by a temperature measurement in a number of radially different positions to deduce by way of the temperature difference, and possibly its progression over time, any uneven wear there may be of the grinding wheel. This allows, for example, an optimum time for dressing to be determined.

In one example, the control unit 160 is programmed such that a dressing process is automatically initiated if the temperature difference $\Delta_{TR}$ becomes greater than a preset temperature difference threshold value. This allows losses in quality on account of uneven wear of the grinding wheels to be avoided without an operator having to intervene. Dressing is initiated in good time before losses in quality occur, but also not earlier than necessary.

Because of the different grinding paths of the inner and outer rows of springs in the loading plate, the springs in the different rows may heat up differently, but also have different lengths. By measuring the temperature of the different rows of springs, a dressing profile with which substantially the same process or the same grinding temperature is achieved in all the rows of springs can be determined, possibly manually or automatically. As a result, it would then be indicated that even removal takes place in all the rows of springs.

A further possibility to control the process with the aid of temperature-dependent closed-loop grinding process control is explained on the basis of FIG. 6. Right at the beginning of the grinding process, it has often been the case in the past that grinding is not performed at the optimum removal rate, but at too low a removal rate. The infeeding of an infeedable grinding wheel in the infeeding process leads initially to a compression of the helical compression springs to be ground so that the grinding pressure only builds up slowly. A typical temperature progression in the case of a conventional infeeding process is schematically represented in the temperature/grinding time diagram of FIG. 6 as curve "SDT". When using the temperature monitoring (dashed curve TEMP), on the other hand, it is possible even in the initial phase of the infeeding to operate very quickly, i.e. with a high infeed rate, without thermally overloading the helical compression springs. In this way, productivity can be additionally increased.

In one example of our methods, it is assumed that there is for the chosen spring material, and possibly other spring parameters, a limit temperature $T_G$, and if the limit is exceeded temperature-induced material damage can no longer be reliably ruled out. The grinding process should therefore be conducted such that a certain safety margin from this limit temperature is reliably maintained. Furthermore, with a view to highest possible productivity, work should be performed at a great infeed rate overall, in order that the grinding operation leads to the desired final dimensions in the shortest possible time. The process is thus conducted such that the infeeding takes place initially at a predetermined maximum infeed rate until a switching point SP is reached, at which the temperature T has approached the limit temperature $T_G$ to within a predeterminable temperature difference ΔT. After reaching the switching point, the infeed rate is reduced and then controlled such that the temperature difference ΔT from the limit temperature remains substantially constant, until the desired final dimensions of the helical compression springs are achieved. After that, the infeedable grinding wheel is withdrawn so that the temperature immediately falls sharply. It is evident from the schematic representation in FIG. 6 that, if the process is conducted in this way, the grinding operation predominantly takes place relatively close to the performance limit, but with a sufficient safety margin from the limit temperature so that the overall grinding time can be significantly lower than in the case of the conventional, more cautious approach.

Some possibilities for the method have been explained on the basis of the examples. In the case of an example not graphically represented, the temperature may be measured at the same time or at different times at both ends of the helical compression springs. This provides the possibility of ensuring by temperature-controlled variation of the cutting rate or rotating speed of the upper and lower grinding wheels that both spring ends are ground at the performance limit, but below the limit temperature. This allows productivity to be further increased. To record the temperature of the springs on their underside, there may, for example, be a second thermal imaging camera provided in the region below the loading plate. It is also possible to carry out an oblique measurement through the middle of the spring from above into the region of the facing-away lower spring end.

In-process temperature measurement during the grinding operation in spring end grinding also allows possible measures for cooling the grinding space or for suction extraction from the grinding space to be aligned exactly with the point concerned on the material being ground and, consequently, determined spring-specifically. Servo-controlled nozzles with feedback and/or closed-loop control of the position of the nozzles by way of the temperature of the spring may be provided for this.

The invention claimed is:

1. A method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, comprising:

determining a temperature signal representing the temperature by a temperature measurement on at least one of the helical compression springs during the grinding operation; and controlling the spring end grinding machine depending on the temperature signal;

wherein a control program is active in the control unit and configured to process the temperature signal or a signal derived from it, and the control unit changes at least one operating parameter of the grinding unit and/or the loading unit depending on the temperature signal during the grinding operation.

2. A method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, comprising:

determining a temperature signal representing the temperature by a temperature measurement on at least one of the helical compression springs during the grinding operation; and controlling the spring end grinding machine depending on the temperature signal;

wherein at least one of a control program is active in the control unit and configured to process the temperature signal or a signal derived from it, and the control unit 1) changes at least one operating parameter of the grinding unit and/or the loading unit depending on the temperature signal during the grinding operation, and/or 2) controls at least one fan that supplies air and/or extracts air by suction depending on temperature signals of the temperature measurement.

3. A method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, comprising:

determining a temperature signal representing the temperature by a temperature measurement on at least one of the helical compression springs during the grinding operation; and controlling the spring end grinding machine depending on the temperature signal;

wherein a limit temperature ($T_G$) corresponding to a tolerable maximum temperature is predetermined, and the control is carried out such that the temperature of the helical spring at a measuring point does not exceed the limit temperature ($T_G$) at any time during the grinding operation.

4. The method as claimed in claim 3, wherein one of the grinding wheels is infed in a direction of the other grinding wheel during the grinding operation at an infeed rate that can be predetermined by the control unit, and the infeed rate is controlled depending on the temperature signal.

5. A method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, comprising:

determining a temperature signal representing the temperature by a temperature measurement on at least one of the helical compression springs during the grinding operation; and controlling the spring end grinding machine depending on the temperature signal;

wherein the temperature of the helical compression spring is determined outside the grinding space, the temperature being measured on a helical compression spring immediately after the helical spring has left the grinding space.

6. A method of grinding spring ends of helical compression springs using a numerically controlled spring end grinding machine having a grinding unit, a loading unit and a control unit that controls the loading unit and the grinding unit, wherein the grinding unit has a pair of grinding wheels comprising two rotatable grinding wheels, between which there is formed a grinding space, and the loading unit has at least one loading plate rotatable substantially axially parallel to the grinding wheels and has a plurality of out-of-axis spring receptacles, each for receiving a helical compression spring, wherein, during a grinding operation, helical compression springs that have been received in spring receptacles are successively transported through the grinding space between the rotating grinding wheels by rotation of the loading plate and, as this happens, both spring ends of the helical compression springs located in the grinding space are in each case simultaneously machined by grinding, comprising:

determining a temperature signal representing the temperature by a temperature measurement on at least one of the helical compression springs during the grinding operation; and controlling the spring end grinding machine depending on the temperature signal;

wherein reference grinding operation data, which represent at least one time-dependent functional relationship between the changing of a grinding parameter and a thereupon-dependent changing of the temperature of helical compression springs, are stored in a memory of the control unit, and the grinding operation is controlled with the reference grinding operation data being taken into account, at least one reference grinding operation preferably being carried out before a grinding operation intended for a production process to determine reference grinding operation data.

7. The method as claimed in claim 6, wherein helical compression springs are arranged at different radial distances from the axis of rotation of the loading plate, separate temperature signals being recorded for at least two radial distances and processed together, data for a radial dressing profile of a grinding wheel preferably being determined on the basis of the separate temperature signals and/or the state of wear of the grinding wheel being assessed on the basis of the separate temperature signals.

8. A spring end grinding machine that grinds spring ends of helical compression springs comprising:

a grinding unit having a pair of grinding wheels comprising two rotatable grinding wheels between which there is formed a grinding space;

a loading unit having at least one loading plate rotatable substantially axially parallel to the grinding wheels and having a plurality of out-of-axis spring receptacles, each receiving a helical compression spring; and a control unit that controls the loading unit and the grinding unit, wherein helical compression springs that have been received in spring receptacles can be successively transported through the grinding space by rotating a loading plate arranged in a working position and, as this happens, both spring ends of the helical compression springs located in the grinding space can be simultaneously machined by grinding, a temperature measuring system with at least one temperature measuring device set to determine a temperature signal representing the temperature on at least one of the helical compression springs during a grinding operation and passing it on for further processing, so that the spring end grinding machine can be controlled in dependence on the temperature signal; and the temperature measuring device is attached such that a temperature measurement during a grinding operation can be carried out immediately after the helical compression springs have left the grinding space, the spring end grinding machine has a movable protective shield which, in an operational position, closes off the grinding space in a direction of exposed parts of the loading plate engaging in the grinding space, a temperature measuring device being attached to the side of the protective shield that is facing away from the grinding wheels.

* * * * *